US011071433B2

(12) United States Patent
He et al.

(10) Patent No.: US 11,071,433 B2
(45) Date of Patent: Jul. 27, 2021

(54) SELF-WRINGING FOAM COTTON MOP WITH LABOR-SAVING WRINGING OPERATION

(71) Applicant: Ningbo Blue Fish Home Technology Co., Ltd., Zhejiang (CN)

(72) Inventors: Min He, Zhejiang (CN); Jian Wu, Zhejiang (CN)

(73) Assignee: Ningbo Blue Fish Home Technology Co., Ltd., Zhejiang (CN)

( * ) Notice: Subject to any disclaimer, the term of this patent is extended or adjusted under 35 U.S.C. 154(b) by 10 days.

(21) Appl. No.: 16/622,289

(22) PCT Filed: Jun. 1, 2018

(86) PCT No.: PCT/CN2018/000203
§ 371 (c)(1),
(2) Date: Dec. 13, 2019

(87) PCT Pub. No.: WO2018/227946
PCT Pub. Date: Dec. 20, 2018

(65) Prior Publication Data

US 2020/0196824 A1 Jun. 25, 2020

(30) Foreign Application Priority Data

Jun. 13, 2017 (CN) ..... 201710442151.6

(51) Int. Cl.
*A47L 13/144* (2006.01)
*A47L 13/24* (2006.01)

(52) U.S. Cl.
CPC ..... *A47L 13/144* (2013.01); *A47L 13/24* (2013.01)

(58) Field of Classification Search
CPC ..... A47L 13/144; A47L 13/24
See application file for complete search history.

(56) References Cited

U.S. PATENT DOCUMENTS 5,172,446 A 12/1992 Schulein
6,148,465 A 11/2000 Hsieh et al.
(Continued)

FOREIGN PATENT DOCUMENTS

CN 2626415 7/2004
CN 201409887 2/2010
(Continued)

OTHER PUBLICATIONS

"International Search Report (Form PCT/ISA/210) of PCT/CN2018/000203," dated Jul. 18, 2018, with English translation thereof, pp. 1-4.

*Primary Examiner* — Randall E Chin
(74) *Attorney, Agent, or Firm* — JCIP Global Inc.

(57) ABSTRACT

A self-wringing foam cotton mop includes a mop rod and a foam cotton head connected to a bottom end of the mop rod. A wringing frame is disposed on the mop rod. During mopping, the foam cotton head is separated from the wringing frame. A squeezing mechanism capable is disposed on the wringing frame. The position of the squeezing mechanism when the foam cotton head is moved up relative to the wringing frame is different from the position of the squeezing mechanism when the foam cotton head is moved down relative to the wringing frame, and a first amount of deformation generated by the foam cotton head during an upward movement of the foam cotton head relative to the wringing frame is greater than the second amount of deformation generated by the foam cotton head during a downward movement of the foam cotton head relative to the wringing frame.

4 Claims, 12 Drawing Sheets

(56) References Cited

U.S. PATENT DOCUMENTS

| | | | | |
|---|---|---|---|---|
| 2002/0162573 | A1 | 11/2002 | Fernandez | |
| 2011/0209300 | A1* | 9/2011 | Dingert | A47L 13/258 15/228 |

FOREIGN PATENT DOCUMENTS

| | | |
|---|---|---|
| CN | 201453183 | 5/2010 |
| CN | 201675886 | 12/2010 |
| CN | 102138771 | 8/2011 |
| CN | 107595218 | 1/2018 |

* cited by examiner

SELF-WRINGING FOAM COTTON MOP WITH LABOR-SAVING WRINGING OPERATION

CROSS-REFERENCE TO RELATED APPLICATION

This application is a 371 of international application of PCT application serial no. PCT/CN2018/000203, filed on Jun. 1, 2018, which claims priority to and the benefit of China Patent Application No. 201710442151.6, filed on Jun. 13, 2017. The entirety of each of the above-mentioned patent applications is hereby incorporated by reference herein and made a part of this specification.

BACKGROUND

Technical Field

The present invention relates to a foam cotton mop, and in particular to a self-wringing foam cotton mop with a labor-saving wringing operation, wherein the foam cotton can be collodion, sponge or the like.

Description of Related Art

Collodion mops available in the market are roughly the same in structure. Such a collodion mop includes a mop rod, a mop head and a wringing mechanism. The wringing device in the collodion mop is a transmission structure. The wringing device includes a handle, a pull rod, a caliper seat (a wringing frame), a collodion clamp and a wringing bar. The caliper seat is roughly U-shaped. A collodion head is clamped by the collodion clamp, and the collodion clamp is fixed at a bottom end of the pull rod. A top end of the pull rod is movably pin-connected to a middle portion of the handle, and a rear end of the handle is pin-connected to the mop rod. The wringing bar is oblate, and two ends of the wringing bar are pin-connected to a lower end of the caliper seat. During a wringing operation, the handle is pulled to drive the collodion head to horizontally move up through the pull rod, and the collodion head passes through the wringing bar of the wringing frame. Since the wringing bar has an elastic force for keeping a clamping trend, the collodion head passing through the wringing bar will be clamped by the wringing bar so as to realize the wringing operation. For example, Chinese Utility Patents, such as Patent No. ZL03231227.X (Publication of CN2626415Y) entitled COLLODION MOP, Patent No. ZL200920121093.8 (Publication of CN201409887Y) entitled INSERTION-TYPE WRINGING COLLODION MOP, Patent No. ZL200920075021.4 (Publication of CN201453183U) entitled COLLODION MOP and Patent No. ZL201110102067.2 (Publication of CN102138771A) entitled MOVABLE MULTIFUNCTIONAL COLLODION MOP, disclosed wringing devices for collodion mops.

During the wringing operation of the existing collodion mops, the handle is pulled to drive the collodion head to horizontally move up through the pull rod, and the collodion head passes through the wringing bar of the wringing frame. Due to certain elasticity of the wringing frame, the wringing bar has an elastic force for keeping a clamping trend, so the collodion head passing through the wringing bar will be squeezed by the wringing bar so as to realize the wringing operation. This wringing approach of the collodion mop has become an inertial thinking for designers, and this wringing approach has the following deficiencies.

Firstly, in this wringing approach, the wringing operation is performed by moving the wringing frame in a height direction of the collodion mop. In order to enable the whole collodion mop to be squeezed by the wringing bar, a transverse length of the wringing bar must approach to a length of the collodion mop. In this way, the wringing part is large in overall transverse length and relatively heavy. In addition, there generally are multiple rows of wringing bars on a front side or a rear side, the material consumption is large, and the contact area of the wringing bars with the collodion head is very large during the wringing process, so that the friction during the wringing operation is greatly increased and the wringing frame is high in cost. Secondly, due to the special structure of the wringing frame, the collodion head and the mop rod must be fixedly connected to each other, and the collodion head cannot be completely separated from the wringing frame, that is, the collodion head cannot be rotated relative to the mop rod. Thus, during the mopping process, it is inconvenient for mopping particular occasions such as a corner, and the adaptability of mopping is low. Thirdly, since a lengthwise direction of the collodion head if perpendicular to an axial direction of the mop rod during the storage of the existing collodion mop, a very large space is required to store the collodion mop, and it is inconvenient for storing the collodion mop. Moreover, the packing boxes for the existing collodion mops is large in size, so less collodion mops are placed in the same space, and the transportation cost is increased.

In conclusion, further improvements can be made to the wringing frames of the existing collodion mops.

SUMMARY

In view of the current situation of the prior art, a technical problem to be solved by the present invention is to provide a self-wringing foam cotton mop with a labor-saving wringing operation which changes the wringing mode of the conventional collodion mops. The mop can ensure excellent wringing effect and labor-saving wringing operation.

To solve the above technical problem, the self-wringing foam cotton mop with a labor-saving wringing operation, comprises a mop rod and a foam cotton head. The foam cotton head is rotatably connected to a bottom end of the mop rod. A wringing frame is disposed on the mop rod. During mopping, the foam cotton head is separated from the wringing frame. A squeezing mechanism capable of squeezing the foam cotton head entering the wringing frame is disposed on the wringing frame. A position of the squeezing mechanism is changeable, so that the position of the squeezing mechanism when the foam cotton head is moved upward relative to the wringing frame is different from the position of the squeezing mechanism when the foam cotton head is moved downward relative to the wringing frame. Therefore, a first amount of deformation generated by the foam cotton head during an upward movement of the foam cotton head relative to the wringing frame is greater than a second amount of deformation generated by the foam cotton head during a downward movement of the foam cotton head relative to the wringing frame.

As a squeezing direction, the squeezing mechanism is adapted for squeezing a bottom surface of the foam cotton head to realize the wringing operation. When the foam cotton head is moved up relative to the wringing frame, the squeezing mechanism enables the foam cotton head to generate the first amount of deformation in a thickness direction. When the foam cotton head is moved down relative to the wringing frame, the squeezing mechanism enables the foam cotton head to generate the second amount of deformation in the thickness direction.

The first amount of deformation being greater than the second amount of deformation can be specifically realized by the following method. A through hole for allowing an end face of the foam cotton head to pass therethrough, and the squeezing mechanism is disposed within the through hole and is able to swing relative to the wringing frame. During a wringing process, the foam cotton head is rotated to allow the end face to be aligned with the through hole. In the process that the foam cotton head enters the through hole and moves up, the squeezing mechanism that does not swing enables the foam cotton head to generate the first amount of deformation. In the process that the foam cotton head enters the through hole and moves down, the swung squeezing mechanism enables the foam cotton head to generate the second amount of deformation. The changeable position of the squeezing mechanism is realized by swinging the squeezing mechanism. In the process that the foam cotton head enters the through hole to move up, the squeezing mechanism that does not swing is always kept in a state of gradually inclining towards the bottom surface of the foam cotton head from the bottom up, so that the squeezing passage is a passage with a larger bottom and a smaller top, and it is advantageous for allowing the foam cotton head to enter the through hole. Moreover, the squeezing force gradually increases, the foam cotton head can be better dewatered, and the wringing operation is labor-saving. In the process that the foam cotton head enters the through hole to move down, the swung squeezing mechanism enables the foam cotton head will deflect to allow the upper end of the squeezing mechanism to move away from the bottom surface of the foam cotton head, so that the entrance at the upper end becomes larger. Thus, it is advantageous for allowing the foam cotton head to exit from the through hole, and the wringing operation is further labor-saving.

The squeezing mechanism includes a squeezing plate and a connecting plate. The squeezing plate is adapted to be in contact with the bottom surface of the foam cotton head, and the squeezing plate is rotatably constrained on the wringing frame and is movable up and down within a certain range in an axial direction of the wringing frame. One end of the connecting plate is rotatably connected to the writing frame, while the other end of the connecting plate is hinged to an upper end of the squeezing plate. An elastic member for allowing a lower end of the connecting plate to keep in a trend of deflecting close to the bottom surface of the foam cotton head and a limiting structure for limiting an upward movement of the connecting plate are provided on the wringing frame. The squeezing plate can come into contact with the bottom surface of the foam cotton head through a wringing roller that is rotatably provided on the squeezing plate. A preferred scheme of the squeezing mechanism has been shown above. In the process that the foam cotton head enters the through hole to move up, the limiting structure prevents the connecting plate from further moving up, so that the connecting plate can be kept at the inclined position. In the process that the foam cotton head enters the through hole to move down, the foam cotton head acts on the connecting plate so that the connecting plate is pulled downward to drive the squeezing plate to move down. Under the drive of the linkage transmission, the upper end of the connecting plate deflects to move away from the bottom surface of the foam cotton head, so that the entrance at the upper end becomes larger and it is advantageous for allowing the foam cotton head to downward passing through the through hole.

Arc-shaped guide grooves are formed on left and right inner sidewalls of the through hole, and guide columns inserted into the guide grooves are provided in a middle portion of left and right sides of the squeezing plate. By limiting the guide columns through upper inner sidewalls of the guide grooves, during the upward movement of the foam cotton head relative to the through hole, the squeezing plate is always kept at a position where it is gradually inclined towards the bottom surface of the foam cotton head from the bottom up. When the squeezing plate is moved up to come the guide columns into contact with the upper inner sidewalls of the guide grooves, the squeezing plate cannot be further moved up, so it is ensured that the squeezing plate is kept at the inclined position.

The squeezing mechanism includes a squeezing plate for coming into contact with the bottom surface of the foam cotton head. One end of the squeezing plate is hinged to the wringing frame. An elastic member for allowing an upper end of the squeezing plate to keep in a trend of deflecting close to the bottom surface of the foam cotton head is disposed on the writing frame, and a limiting portion for limiting the rotation position of the squeezing plate is disposed on the wringing frame. Under a combined action of the elastic member and the limiting portion, the squeezing plate is always kept in a state of gradually inclined toward the bottom surface of the foam cotton head from the bottom up. A second structural scheme of the squeezing mechanism has been shown above.

The squeezing mechanism includes a squeezing plate for being contact with the bottom surface of the foam cotton head. One end of the squeezing plate is hinged to the wringing frame; a limiting portion for limiting a rotation position of the squeezing plate is provided on the wringing frame. The squeezing plate is locked within the through hole by a locking structure that can be unlocked, and the squeezing plate is kept at a position where it is gradually inclined towards the bottom surface of the foam cotton head from the bottom up when an upper end of the squeezing plate is locked by the locking structure. A third structural scheme of the squeezing mechanism has been shown above. Specifically, the locking structure includes a first lock bar and a second lock bar which are arranged left and right in the squeezing plate at interval and can slide left and right. A first lock hole and a second lock hole are formed on left and right sidewalls of the through hole; a support spring is provided between the first lock bar and the second lock bar. The support spring keeps the first lock bar and the second lock bar in a trend of extending outward and being separately inserted into the first lock hole and the second lock hole. A fourth structural scheme of the squeezing mechanism has been shown above.

The squeezing mechanism includes a squeezing plate. A wringing roller for coming into contact with the bottom surface of the foam cotton head is provided on the squeezing plate. An upper end of the squeezing plate is hinged within the through hole and enables a lower end of the squeezing plate to swing; an elastic member for keeping the lower end of the squeezing plate in a trend of blocking the main through hole and a limiting portion for limiting the rotation position of the squeezing plate are provided within the through hole. In a state where the lower end of the squeezing plate is overturned to resist against the limiting position, the squeezing plate is kept at a position where it is gradually inclined towards the bottom surface of the foam cotton head from the bottom up. A fifth structural scheme of the squeezing mechanism has been shown above.

The wringing frame consists of a wringing handle, a connecting rod and a wringing tip. The wringing handle is sheathed on the mop rod and able to slide in the axial direction, the wringing handle is connected to the wringing tip through the connecting rod, and the through hole is formed on the wringing tip. When the wringing tip is located at a lower position, a lower end of the foam cotton head is located within the through hole, and the wringing tip transversely extends to form the ground. Therefore, when the wringing tip is located at a lower position, the wringing tip can act as a pedestal, so that the lower end of the foam cotton head parallel to the mop rod is inserted into the through hole and the mop can be placed vertically. At the end of the wringing operation, the whole mop (including the foam cotton head) can be placed vertically. Thus, it is advantageous for drying the foam cotton on the foam cotton head in the air, and the foam cotton will not get dirty since it comes into contact with the bottom surface again. In the case where the foam cotton head is dry, the foam cotton head will become hard, and in combination with the swingable squeezing mechanism structure of the mop, it is advantageous for the dry and hard foam cotton head to pass through the through hole.

As another squeezing direction, the squeezing mechanism is adapted for squeezing side faces of front and rear sides of the foam cotton head. When the foam cotton head is moved up relative to the wringing frame, the squeezing mechanism enables the foam cotton head to generate the first amount of deformation in a width direction. When the foam cotton head is moved down relative to the wringing frame, the squeezing mechanism enables the foam cotton head to generate the second amount of deformation in the width direction.

The wringing frame has a through hole for allowing an end face of the foam cotton head to pass therethrough. There are two squeezing mechanisms which are respectively arranged on front and rear sides inside the through hole and can swing relative to the wringing frame. During a wringing process, the foam cotton head is rotated to allow the end face to be aligned with the through hole. In the process that the foam cotton head enters the through hole and moves up, the two squeezing mechanisms that do not swing enable the foam cotton head to generate the first amount of deformation. In the process that the foam cotton head enters the through hole and moves down, the two swung squeezing mechanisms enable the foam cotton head to generate the second amount of deformation.

At least one of the squeezing mechanisms includes squeezing plate and a connecting plate. A wringing roller for being contact with the side surface of the foam cotton head is provided on the squeezing plate, and the squeezing plate is rotatably constrained on the wringing frame and is movable up and down within a certain range in an axial direction of the wringing frame. One end of the connecting plate is rotatably connected to the wringing frame, while the other end of the connecting plate is hinged to an upper end of the squeezing plate. An elastic member for keeping a lower end of the connecting plate in a trend of deflecting close to the side face of the foam cotton head and a limiting structure for limiting an upward movement of the connecting plate are provided on the wringing frame.

Compared with the prior art, the present invention has the following advantages. In the schemes, the wringing approach of the existing foam cotton mops is completely overturned. Since a squeezing mechanism capable of squeezing the foam cotton head through the wringing frame is provided on the wringing frame and the squeezing mechanism is designed to be movable, the position of the squeezing mechanism when the foam cotton head is moved up relative to the foam cotton head is different from the position of the squeezing mechanism when the foam cotton head is moved up relative to the wringing frame, and the first amount of deformation generated by the foam cotton head during the upward movement of the foam cotton head relative to the wringing frame is greater than the second amount of deformation generated by the foam cotton head during the downward movement of the foam cotton head relative to the wringing frame. During the wringing process, the wringing frame slides up and down in a lengthwise direction of the foam cotton head, and the squeezing mechanism squeezes the foam cotton head through the wringing frame. Since the squeezing mechanism comes into contact with foam cotton head only in the thickness direction, the contact distance is short, the resistance during the wringing operation is small, and the wringing operation is labor-saving. In the structure, due to the special design of the movable squeezing mechanism, the first amount of deformation generated by the foam cotton head during the upward movement of the foam cotton head relative to the wringing frame is greater than the second amount of deformation generated by the foam cotton head in the thickness direction during the downward movement of the foam cotton head relative to the wringing frame. If the amount of deformation is smaller, it is indicated that the friction between the foam cotton head and the squeezing mechanism is smaller, and the operation is more labor-saving. Particularly in the case where the foam cotton head is dry, the foam cotton head will become hard, and in combination with the swingable squeezing mechanism structure of the mop, it is advantageous for the dry and hard foam cotton head to pass through the through hole.

DESCRIPTION OF THE EMBODIMENTS

Figure 1:
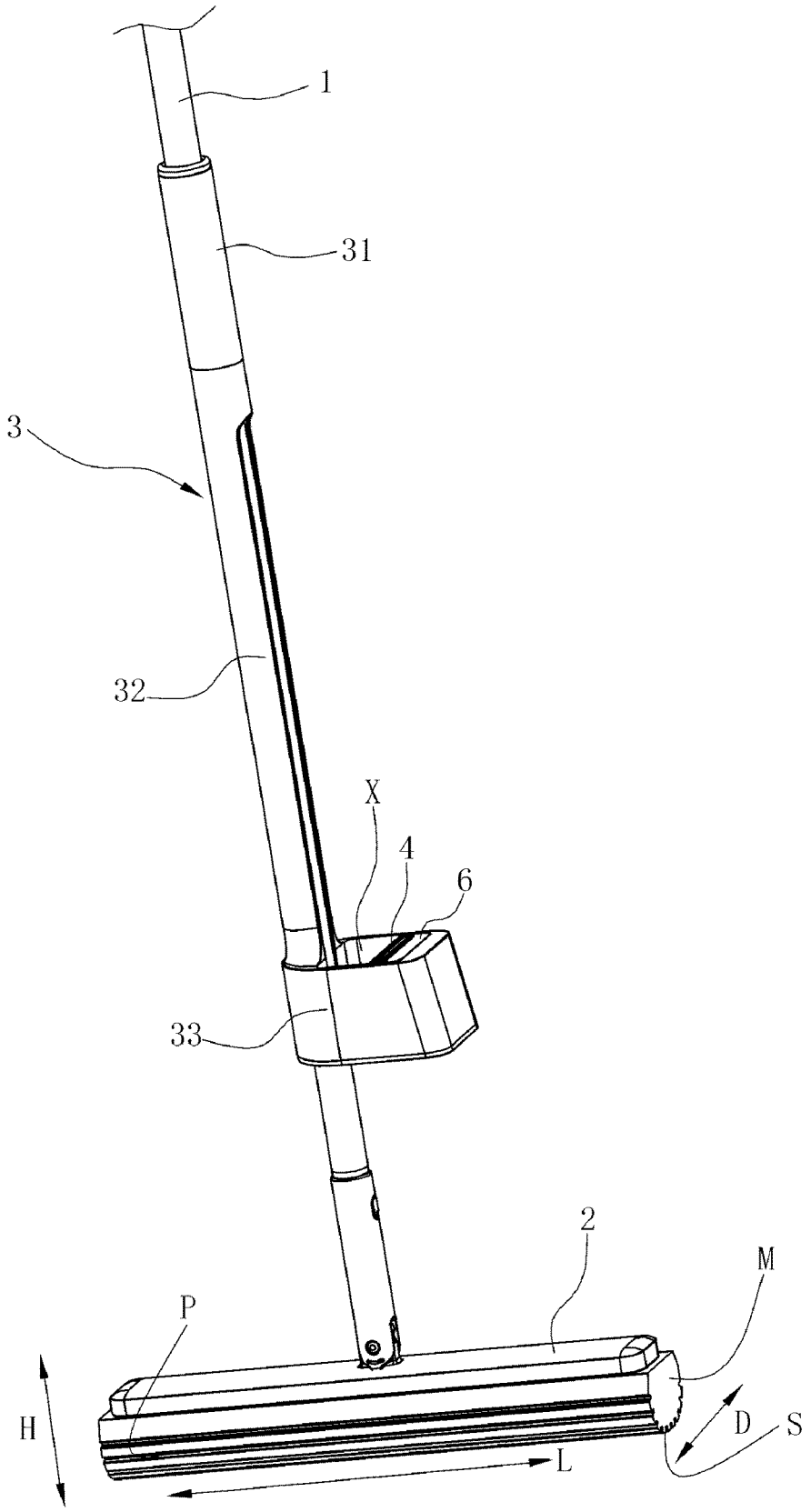
FIG. 1 is a perspective view according to a first embodiment of the present invention (in a normal mopping state)
Figure 2:
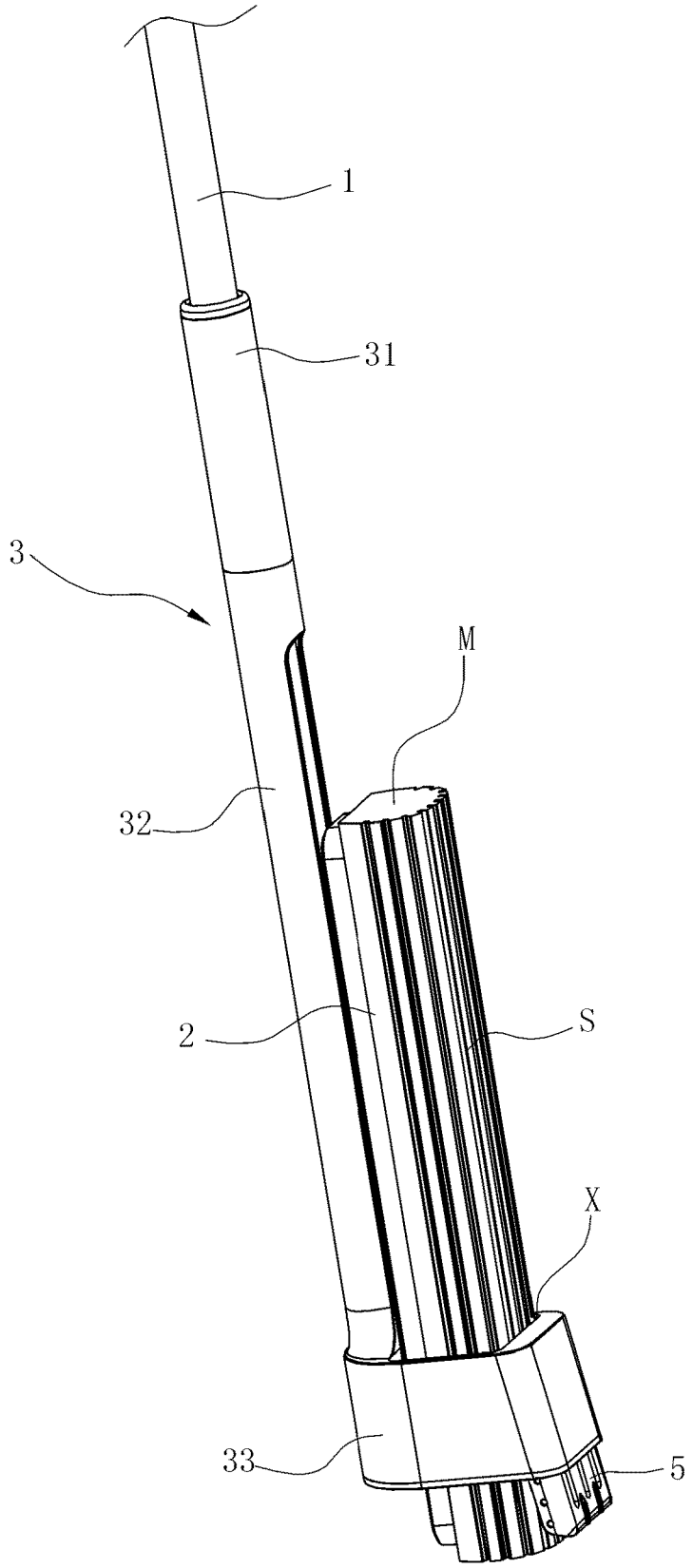
FIG. 2 is a perspective view the first embodiment (in a wringing and moving-down state)
Figure 3:
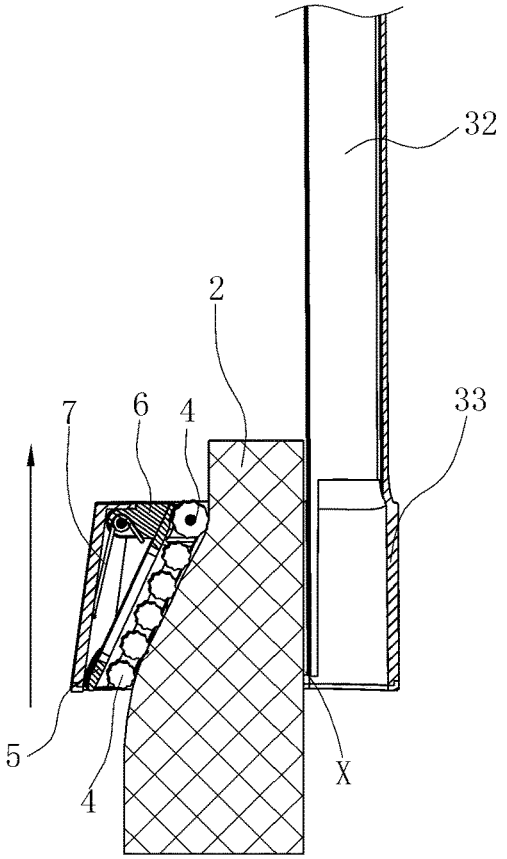
FIG. 3 is a partially sectional view of the first embodiment (in a state where a foam cotton head is moved up)

To enable a further understanding of the present invention content of the invention herein, refer to the detailed description of the invention and the accompanying drawings below:

As shown in FIGS. 1-8, a first embodiment of the present invention is shown.

A self-wringing foam cotton mop with a labor-saving wringing operation is provided, including a mop rod 1 and a foam cotton head 2. The foam cotton head 2 is rotatably connected to a bottom end of the mop rod 1. A wringing frame 3 capable of sliding along the mop rod 1 is provided on the mop rod 1, and the wringing frame 3 has a through hole X for allowing an end face M of the foam cotton head 2 to pass therethrough. The end face M refers to surfaces of two sides of the foam cotton head 2 in a lengthwise direction L. A squeezing mechanism capable of moving (e.g., swinging) relative to the wringing frame 3 is provided on an inner front side of the through hole X, so that a position of the squeezing mechanism during an upward movement of the foam cotton head 2 relative to the wringing frame 3 is different from the position of the squeezing mechanism during a downward movement of the foam cotton head 2 relative to the wringing frame 3. During the wringing process, the foam cotton head 2 is rotated to allow the end face M to be aligned with the through hole X, the foam cotton head 2 enters and passes through the through hole X to squeeze a bottom surface S of the foam cotton head 2 via the squeezing mechanism so as to realize the wringing operation. During the mopping process, the foam cotton head 2 is completely separated from the through hole X. In the process that the foam cotton head 2 enters the through hole X and moves up, the squeezing mechanism that does not swing enables the foam cotton head 2 to generate a first amount of deformation Δh1 in a thickness direction. In the process that the foam cotton head 2 enters the through hole X and moves down, the swung squeezing mechanism enables the foam cotton head 2 to generate a second amount of deformation Δh2 in the thickness direction H, where the first amount of deformation Δh1 is greater than the second amount of deformation Δh2. In this embodiment, it should be understood that the amount of deformation is a difference between a thickness of the foam cotton state 2 under normal conditions and the thickness of the foam cotton head 2 after being squeezed and deformed.

In the process that the foam cotton head 2 entering the through hole X to move up relative to the wringing frame 3, the squeezing mechanism is always kept in a state of gradually inclining towards the bottom surface S of the foam cotton head 2 from the bottom up. In the process of the foam cotton head 2 entering the through hole X to move down relative to the wringing frame 3, the squeezing mechanism will deflect or displace to allow an upper end of the squeezing mechanism to move away from the bottom surface S of the foam cotton head 2.

In this embodiment, the squeezing mechanism comprises a squeezing plate 5 and a connecting plate 6. A wringing roller 4 for coming into contact with the bottom surface S of the foam cotton head 2 is provided on the squeezing plate 5, and the squeezing plate 5 is rotatably constrained within the through hole X and movable up and down within a certain range in an axial direction of the through hole X. One end of the connecting plate 6 is rotatably connected to the wringing frame 3, while the other end of the connecting plate 6 is hinged to an upper end of the squeezing plate 5. An elastic member 7 for keeping a lower end of the connecting plate 6 deflected close to the bottom surface S of the foam cotton head 2 is provided within the through hole X. The elastic member 7 is a torsion spring. A limiting structure for limiting an upward movement of the connecting plate 6 is provided within the through hole X.

In the process that the foam cotton head 2 enters the through hole X to move up relative to the wringing frame 3, under the action of the elastic member 7 and the connecting plate 6, the squeezing plate 5 is always kept in a state of gradually inclining towards the bottom surface S of the foam cotton head 2 from the bottom up. In the process that the foam cotton head 2 enters the through hole X to move down relative to the wringing frame 3, the foam cotton head 2 can trigger the connecting plate 6 to overcome an elastic force of the elastic member 7 to deflect, and the connecting plate 6 drives the upper end of the squeezing plate 5 to move away from the bottom surface S of the foam cotton head 2. The limiting structure includes arc-shaped guide grooves 8 formed on left and right inner sidewalls of the through hole X, and guide columns 51 inserted into the guide grooves 8 are provided in a middle portion of left and right sides of the squeezing plate 5. By limiting the guide columns 51 through upper inner sidewalls of the guide grooves 8, during the upward movement of the foam cotton head 2 relative to the through hole X, the squeezing plate 5 is always kept at a position where it is gradually inclined towards the bottom surface S of the foam cotton head 2 from the bottom up.

Figure 4:
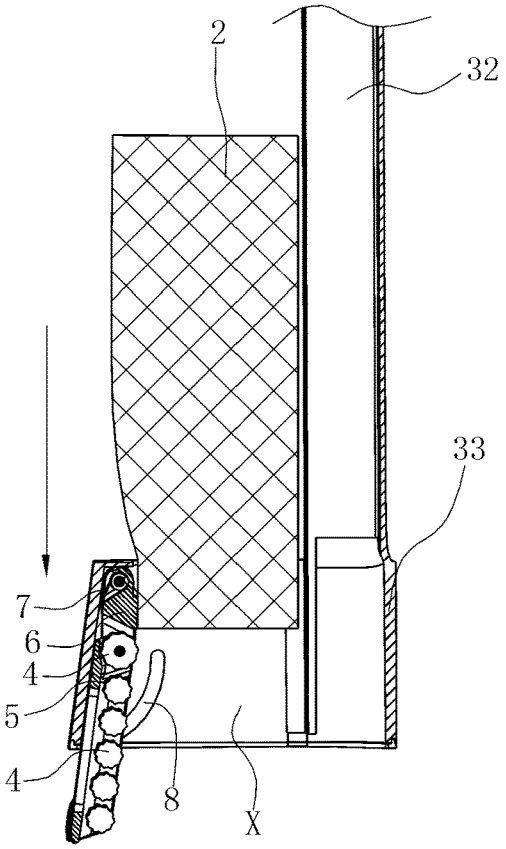
FIG. 4 is a partially sectional view of the first embodiment (in a state where the foam cotton head is moved down)
Figure 5:
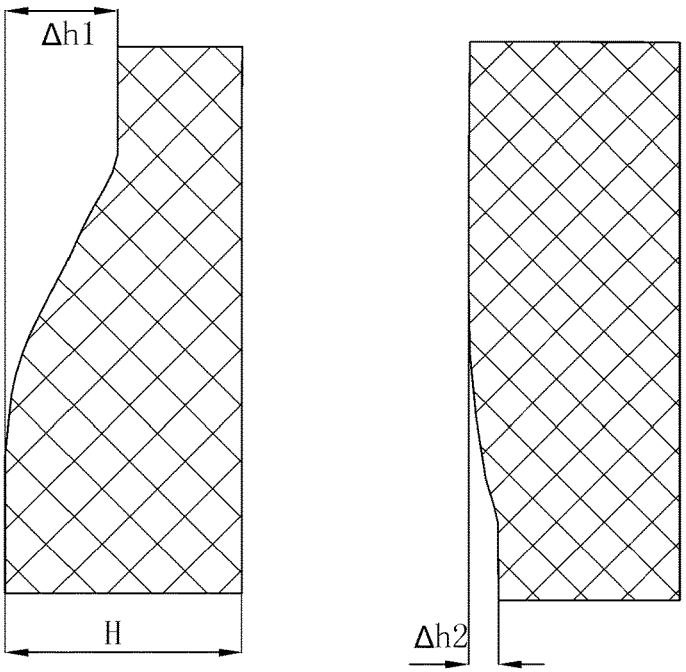
FIG. 5 is a comparison view of two amounts of deformation of the foam cotton head in the first embodiment.
Figure 6:
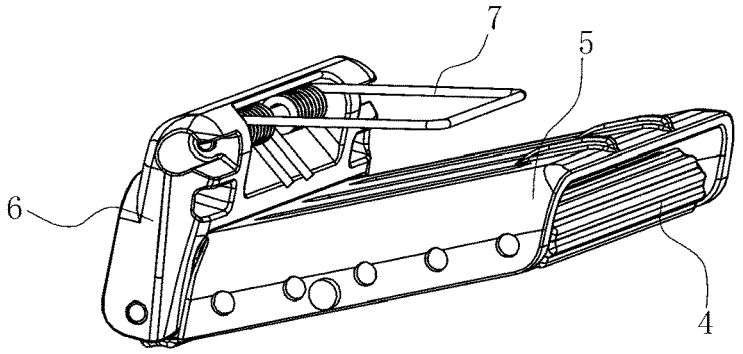
FIG. 6 is a perspective view of a squeezing mechanism in the first embodiment (in a state where the foam cotton head is moved up)
Figure 7:
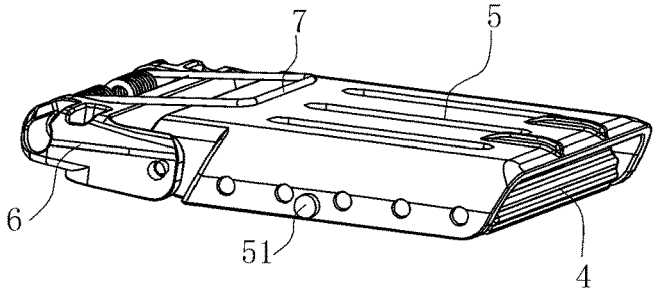
FIG. 7 is a perspective view of the squeezing mechanism in the first embodiment (in a state where the foam cotton head is moved down)
Figure 8:
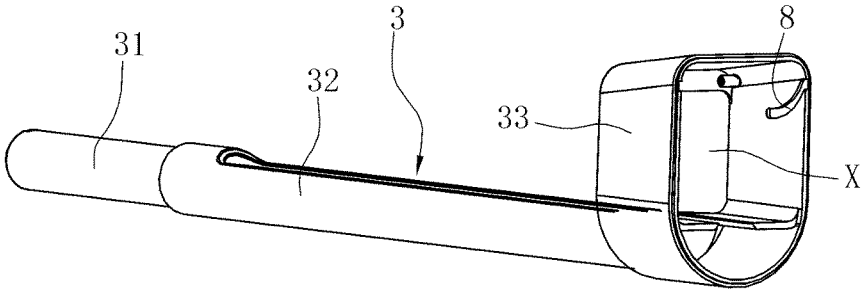
FIG. 8 is a perspective view of a wringing frame in the first embodiment.

The wringing frame 3 consists of a wringing handle 31, a connecting rod 32 and a wringing tip 33. The wringing handle 31 is sheathed on the mop rod 1 and is able to slide in the axial direction, the wringing handle 31 is connected to the wringing tip 33 through the connecting rod 32, and the through hole X is formed on the wringing tip 33. As shown in FIG. 4, when the wringing tip 33 is located at a lower position, a one end of the foam cotton head 2 is located in the through hole X, and the wringing tip 33 transversely extends to form the ground. Therefore, when the wringing tip 33 is located at a lower position, the wringing tip 33 can act as a pedestal, so that the end of the foam cotton head 2 parallel to the mop rod 1 is inserted into the through hole X and the mop can be placed vertically.

In this embodiment, an up-down direction refers to the lengthwise direction of the mop rod 1. A front-rear direction refers to the width direction D of the foam cotton head 2. A left-right direction is perpendicular to the front-rear direction, i.e., the lengthwise direction L of the foam cotton head 2 in a mopping state, and the thickness direction refers to a direction basically perpendicular to the bottom surface S of the foam cotton head 2.

The operating principle and process in this embodiment are described below.

Wringing operation: the foam bottom head 2 is rotated to be basically parallel to the mop rod 1 and directly face the through hole X. The wringing handle 31 is held by one hand, the mop rod 1 is held by the other hand, and the wringing handle 31 is pushed to slide up and down relative to the mop rod 1, so that the foam cotton head 2 enters and passes through the through hole X to squeeze the bottom surface S of the foam cotton head 2 so as to realize the wringing operation. In the process that the foam cotton head 2 enters the through hole X to move up relative to the wringing frame 3, due to the action of the elastic member 7 and the connecting plate 6, the squeezing plate 5 is always kept in a state of gradually inclining towards the bottom surface S of the foam cotton head 2 from the bottom up, so that the squeezing passage is a passage with a larger bottom and a smaller top, and it is advantageous for allowing the foam cotton head 2 to enter the through hole X. Moreover, the squeezing force gradually increases, the foam cotton head can be better dewatered, and the wringing operation is labor-saving. In the process that the foam cotton head 2 enters the through hole X to move down relative to the wringing frame 3, the foam cotton head 2 can trigger the connecting plate 6 to overcome the elastic force of the elastic member 7 to deflect, and the connecting plate 6 drives the upper end of the squeezing plate 5 to move away from the bottom surface S of the foam cotton head 2. Thus, it is advantageous for the foam cotton head 2 to downward passing through the squeezing passage.

Particularly in the case where the foam cotton head 2 is dry, the foam cotton head 2 will become hard, and in combination with the swingable squeezing mechanism structure of the mop, it is advantageous for the dry and hard foam cotton head 2 to pass through the through hole X.

Mopping operation: the wringing frame 3 is held by one hand, the mop rod 1 is held by the other hand, and the wringing handle 31 is pulled up to move up to a higher position relative to the mop rod 1 until the foam cotton head 2 is completely separated from the wringing tip 33. At this time, since the wringing handle 31 is located at a higher position, the foam cotton head 2 is completely separated from the wringing tip 33 during the mopping proves. Therefore, the foam cotton head 2 is movably connected to the lower end of the mop rod 1, the foam cotton head 2 can be deflected at will during the mopping process, and the operation is more comfortable and reasonable.

Figure 9:
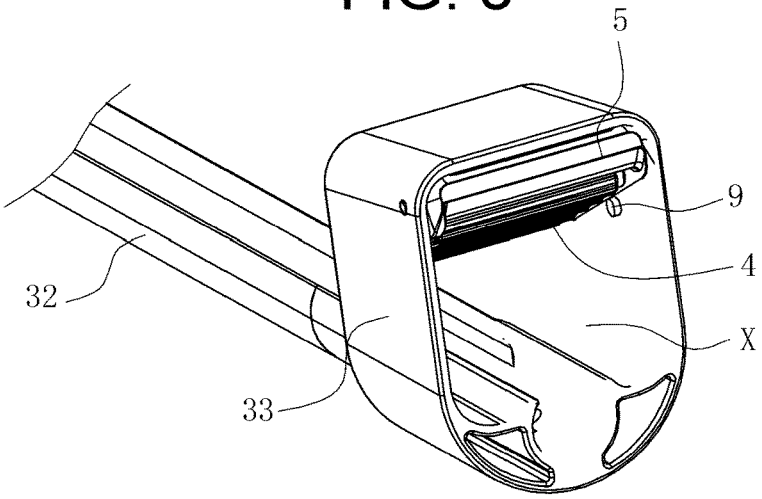
FIG. 9 is a perspective view of the wringing frame equipped with a wringing component according to a second embodiment of the present invention (in a state where the foam cotton head is moved up)
Figure 10:
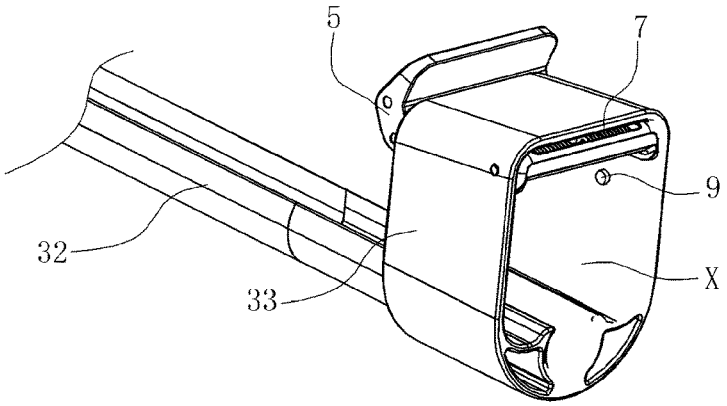
FIG. 10 is a perspective view of the wringing frame equipped with the wringing component in the second embodiment (when a squeezing plate is deflected for evasion)

As shown in FIGS. 9 and 10, a second embodiment of the present invention is shown.

Differences between this embodiment and the first embodiment are as follows. The squeezing mechanism includes a squeezing plate 5. A wringing roller 4 adapted to be in contact with the bottom surface S of the foam cotton head 2 is provided on the squeezing plate 5, and a lower end of the squeezing plate 5 is hinged within the through hole X. An elastic member 7 for keeping an upper end of the squeezing plate 5 in a trend of deflecting close to the bottom surface S of the foam cotton head 2 is provided within the through hole X, and the elastic member 7 is a torsion spring. A limiting portion 9 for limiting a rotation position of the squeezing plate 5 is further provided within the through hole X. Under the combined action of the elastic member 7 and the limiting portion 9, the squeezing plate 5 is always kept in a state of gradually inclining towards the bottom surface S of the foam cotton head 2 from the bottom up. The upper end of the squeezing plate 5 has a guide surface that extends outward from the through hole and looks like a slope.

The limiting portion 9 is a stop column for limiting two sides of the bottom surface of the squeezing plate 5 for purpose of avoiding excessive turnover of an upper end of the squeezing plate 5. In this embodiment, the elastic member 7 applies a large force to the squeezing plate 5. In the process that the foam cotton head 2 enters the through hole X to move down, if the foam cotton head becomes very hard, the forced applied to the squeezing plate 5 by the foam cotton head is larger than the force applied to the squeezing plate 5 by the elastic member 7, so the opening becomes larger and it is advantageous for the foam cotton head to run downward.

Figure 11:
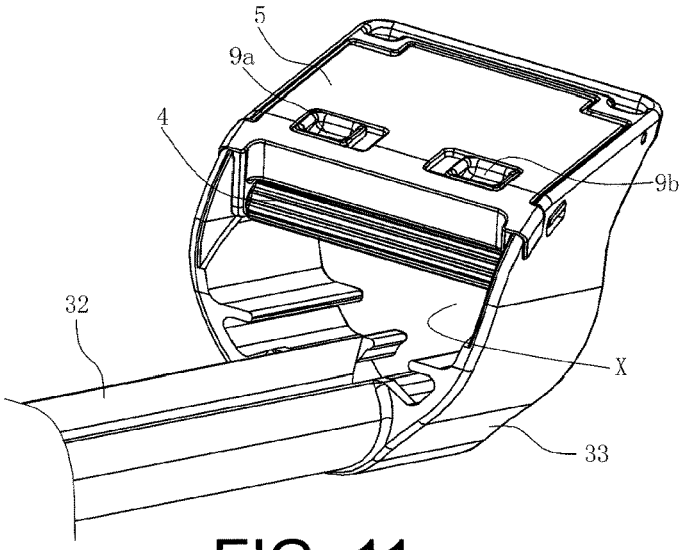
FIG. 11 is a perspective view of the wringing frame equipped with the wringing component according to a third embodiment of the present invention (in a state where the foam cotton head is moved up)
Figure 12:
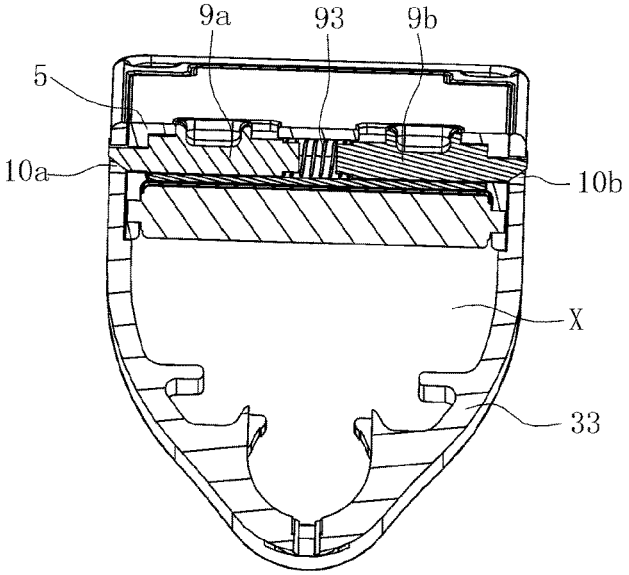
FIG. 12 is a sectional view of the wringing frame equipped with the wringing component in the third embodiment.

As shown in FIGS. 11 and 12, a third embodiment of the present invention is shown.

Differences between this embodiment and the first embodiment are as follows. The squeezing mechanism includes a squeezing plate 5. A wringing roller 4 for coming into contact with the bottom surface S of the foam cotton head 2 is provided on the squeezing plate 5, and a lower end of the squeezing plate 5 is hinged within the through hole X. A limiting portion 9 for limiting a rotation position of the squeezing plate 5 is provided within the through hole X, and an upper end of the squeezing plate 5 is locked within the through hole X by a locking structure that can be unlocked. In a state where an upper end of the squeezing plate 5 is locked by the locking structure, the squeezing plate 5 is kept at a position where it is gradually inclined towards the bottom surface S of the foam cotton head 2 from the bottom up.

The locking structure includes a first lock bar **9*a* and a second lock bar 9*b* which are arranged left and right within the squeezing plate 5 at interval and can slide left and right. A first lock hole 10*a* and a second lock hole 10*b* are formed on left and right sidewalls of the through hole X. A support spring 91 is provided between the first lock bar 9*a* and the second lock bar 9*b*. The support spring 91 keeps the first lock bar 9*a* and the second lock bar 9*b* in a trend of extending outward and being separately inserted into the first lock 10*a* and the second lock hole 10*b*, and the first lock bar 9*a* and the second lock bar 9*b* are exposed from an outer surface of the squeezing plate 5** for allowing them to be driven by a user.

The limiting portion 9 is a stop column for limiting two sides of the bottom surface of the squeezing plate 5 for purpose of avoiding excessive turnover of the upper end of the squeezing plate 5. In the process of the foam cotton head 2 entering the through hole X to move down, the squeezing plate 5 is unlocked first. In this way, the squeezing plate 5 can freely swing back and forth, and the foam cotton head 2 can trigger the squeezing plate 5 and drive the upper end of the squeezing plate 5 to move away from the foam cotton head 2, so that it is advantageous for the foam cotton head 2 to downward passing through the squeezing passage.

Figure 13:
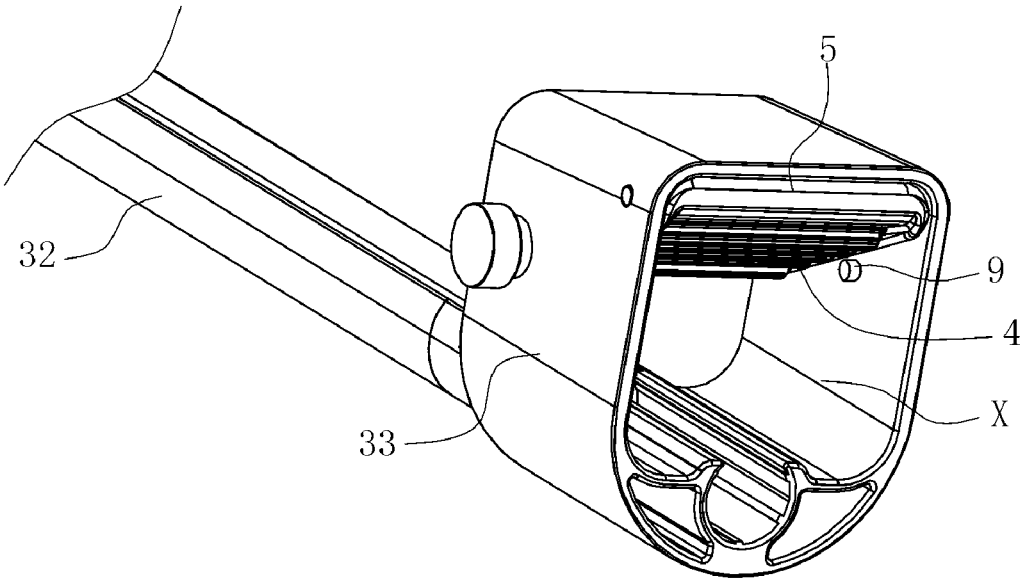
FIG. 13 is a perspective view of the wringing frame equipped with the wringing component in a fourth embodiment (when the squeezing plate is inclined)
Figure 14:
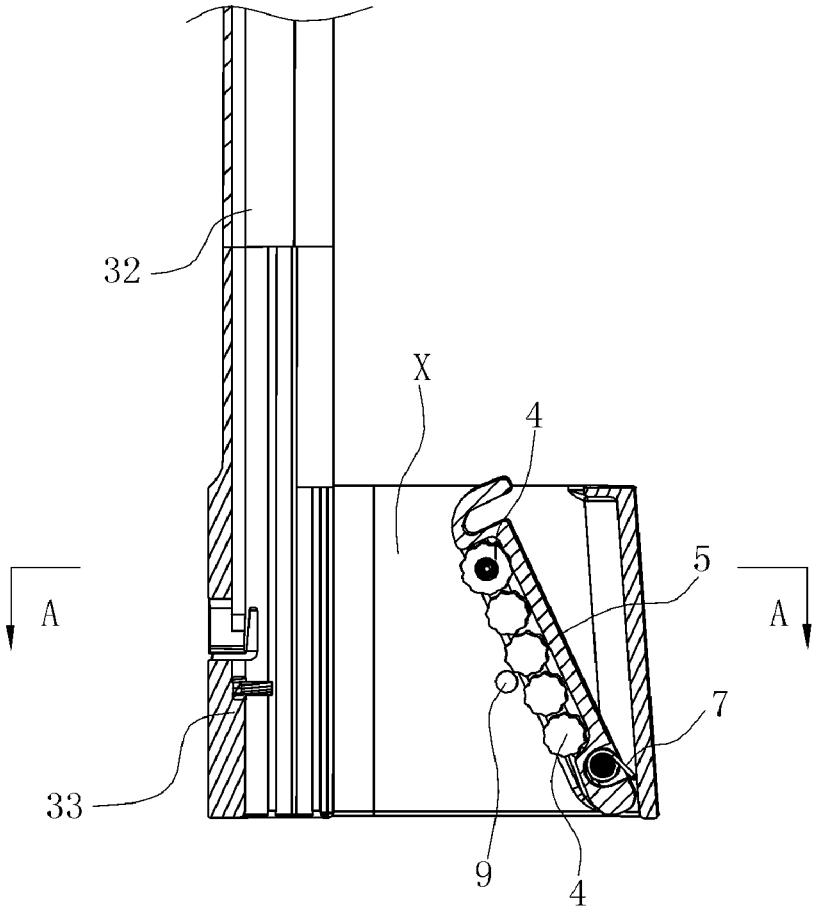
FIG. 14 is a sectional view of the wringing frame equipped with the wringing component according to the fourth embodiment of the present invention.
Figure 15:
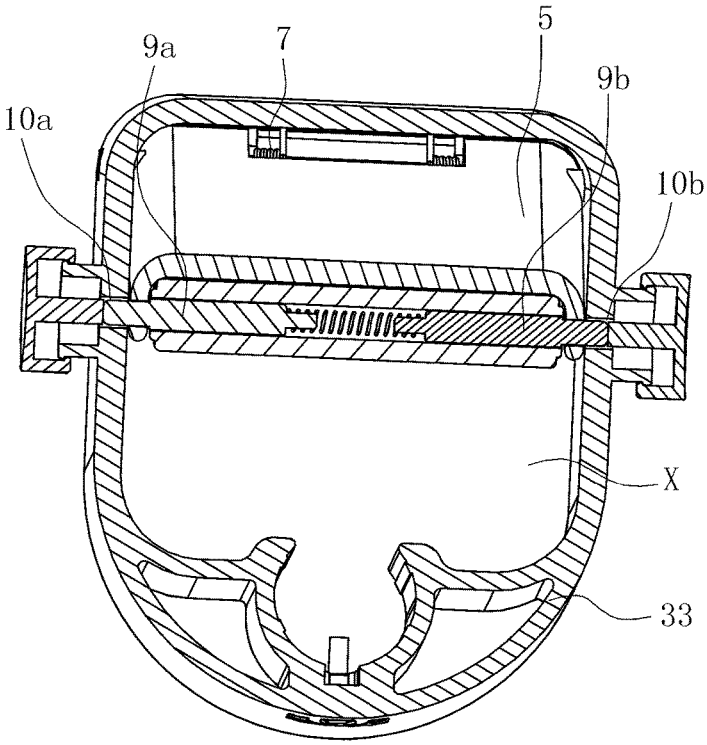
FIG. 15 is a sectional view of FIG. 14 in a direction A-A.
Figure 16:
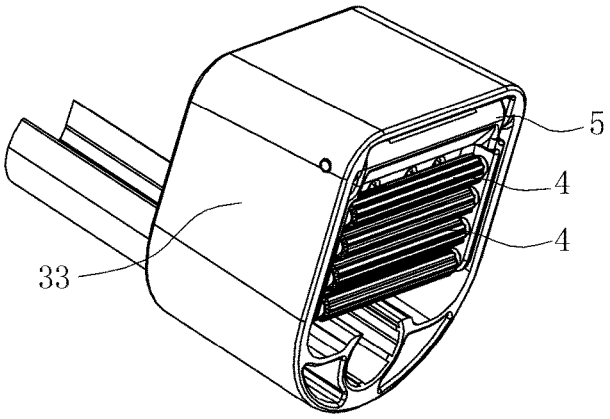
FIG. 16 is a perspective view the wringing frame equipped with the wringing component according to a fifth embodiment of the present invention (in a mopping state)
Figure 17:
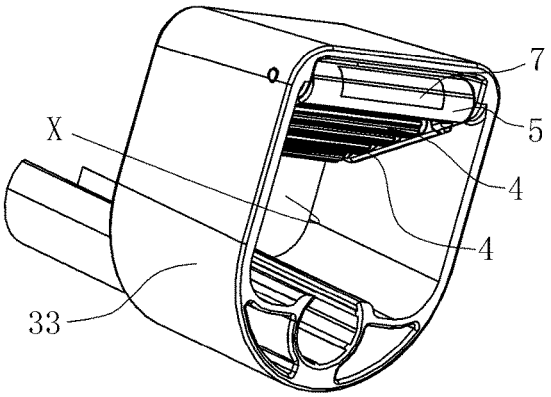
FIG. 17 is a first perspective view the wringing frame equipped with the wringing component in the fifth embodiment (in a state where the foam cotton head is moved up)
Figure 18:
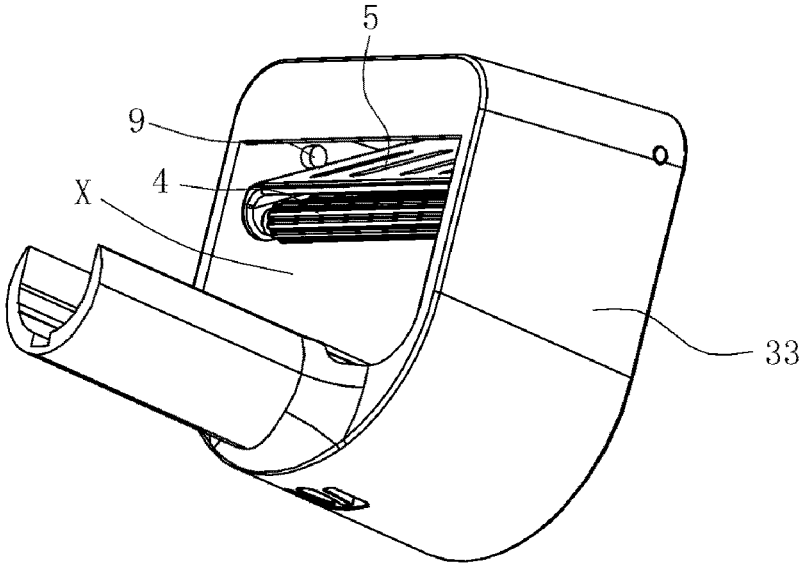
FIG. 18 is a second perspective view the wringing frame equipped with the wringing component in the fifth embodiment (in a state where the foam cotton head is moved up)
Figure 19:
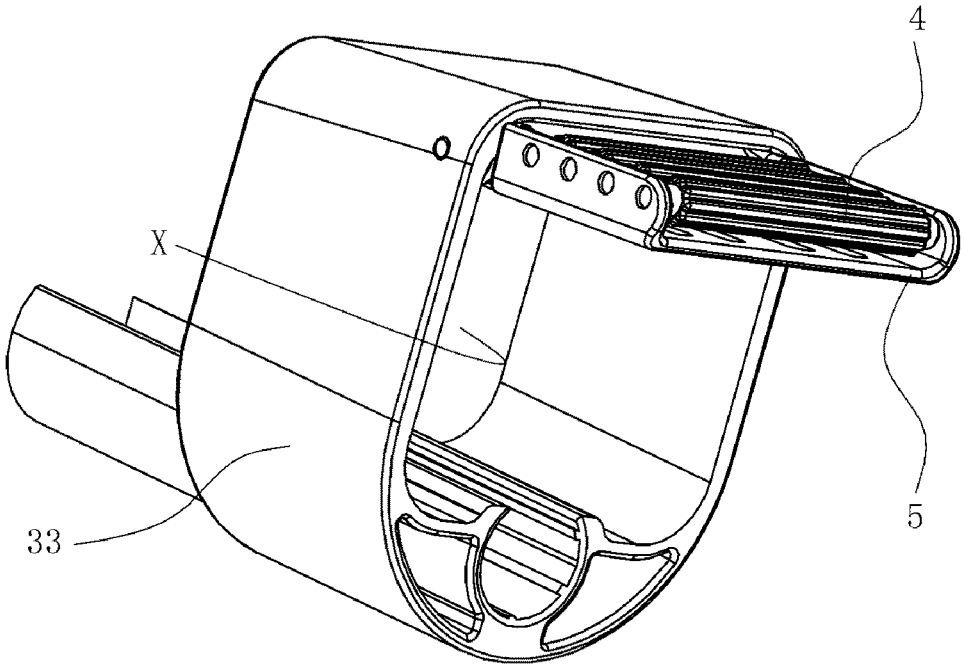
FIG. 19 is a second perspective view the wringing frame equipped with the wringing component in the fifth embodiment (in a state where the foam cotton head is moved down)
Figure 20:
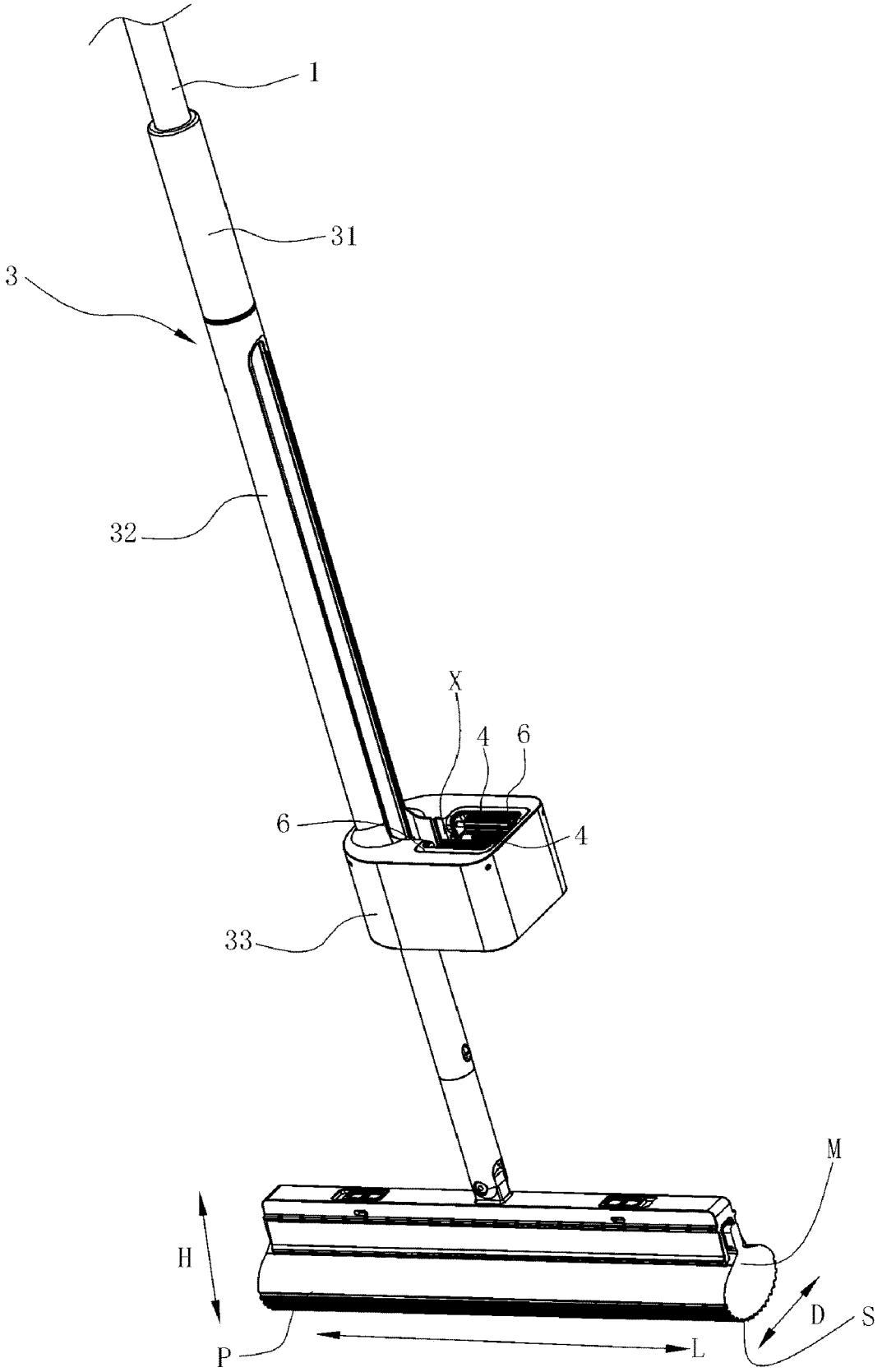
FIG. 20 is a perspective view according to a sixth embodiment of the present invention (in a normal mapping state)
Figure 21:
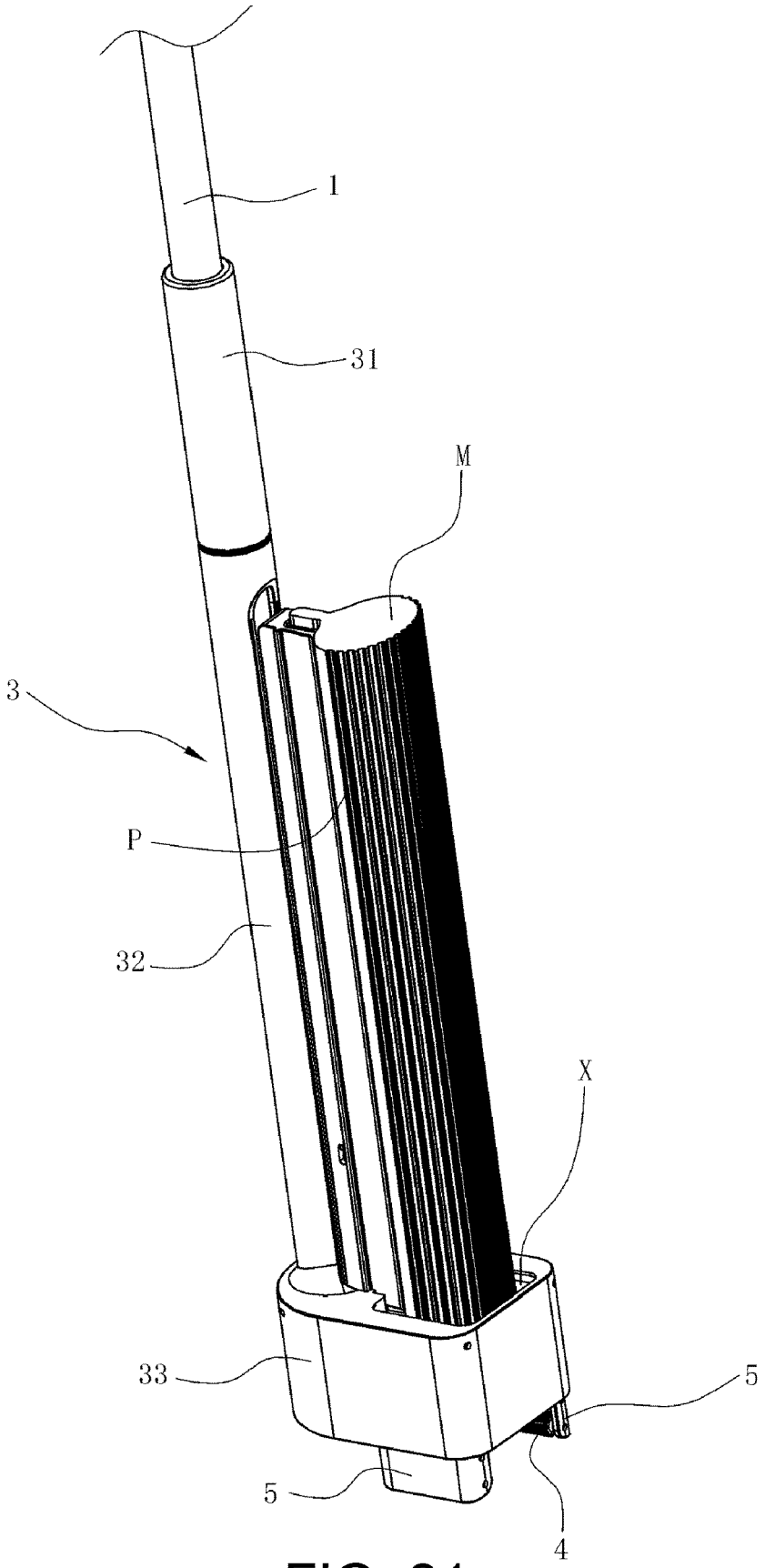
FIG. 21 is a perspective view of the sixth embodiment (in the wringing and moving-down state)
Figure 22:
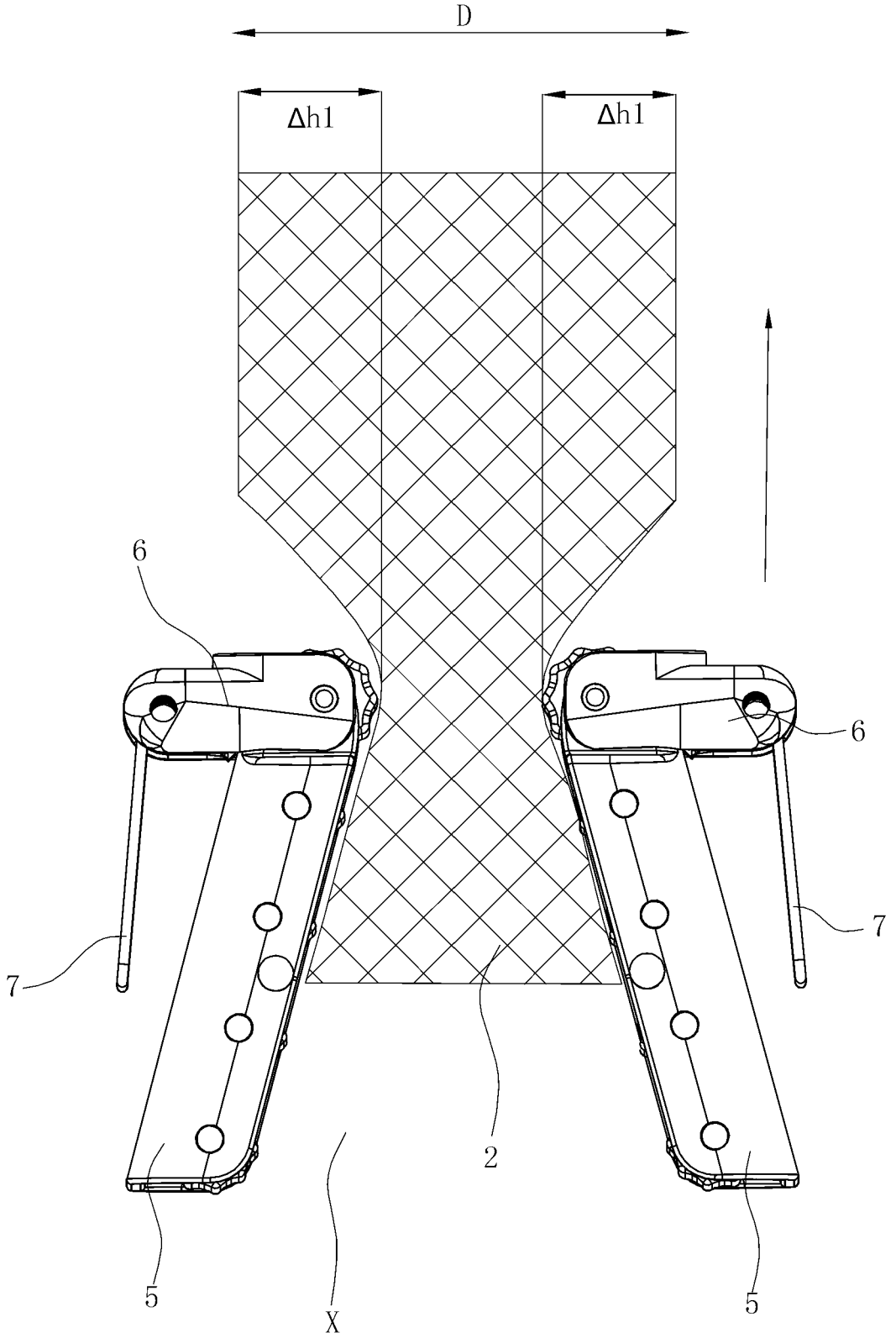
FIG. 22 is a partially perspective view of the sixth embodiment (in the state where the foam cotton head is moved up)
Figure 23:
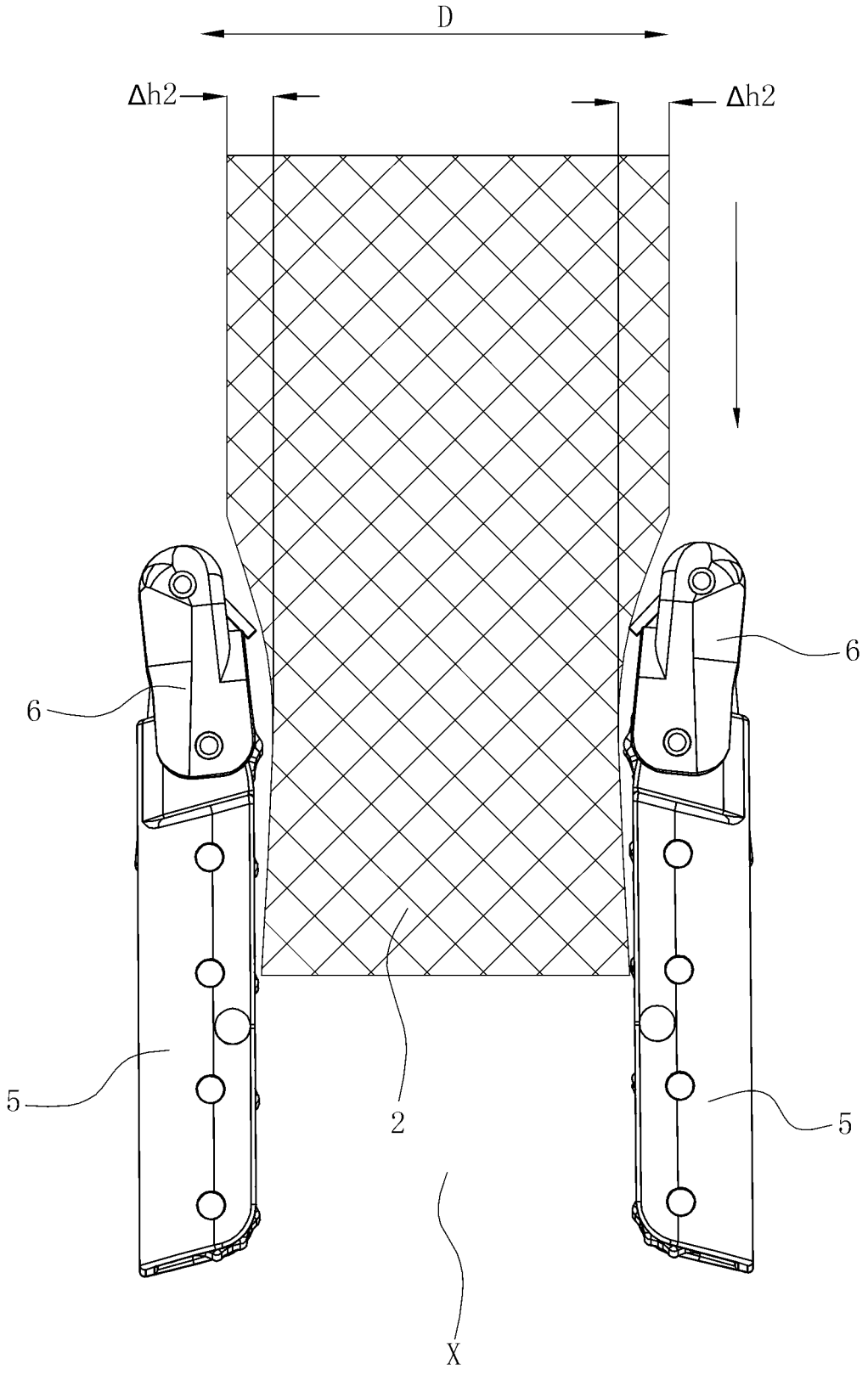
FIG. 23 is a partially perspective view of the sixth embodiment (in the state where the foam cotton head is moved down).

As shown in FIGS. 13-15, a fourth embodiment of the present invention is shown.

Differences between this embodiment and the third embodiment are as follows. An elastic member 7 for keeping the upper end of the squeezing plate 5 in a trend of deflecting close to the bottom surface S of the foam cotton head 2 is provided within the through hole X.

As shown in FIGS. 16-19, a fifth embodiment of the present invention is shown.

Differences between this embodiment and the first embodiment are as follows. The squeezing mechanism includes a squeezing plate 5. A wringing roller 4 for coming into contact with the bottom surface S of the foam cotton head 2 is provided on the squeezing plate 5, and an upper end of the squeezing plate 5 is hinged within the through hole X and enables the lower end of the squeezing plate 5 to swing. An elastic member 7 for keeping the lower end of the squeezing plate 5 in a trend of blocking the main through hole X and a limiting portion 9 for limiting a rotation position of the squeezing plate 5 are provided within the through hole X. In a state where the lower end of the squeezing plate 5 is overturned to resist against the limiting portion 9, the squeezing plate 5 is kept at a position where it is gradually inclined towards the bottom surface S of the foam cotton head 2 from the bottom up.

The limiting portion 9 is a stop column for limiting two sides of the bottom surface of the squeezing plate 5 for purpose of avoiding excessive turnover of the upper end of the squeezing plate 5. In the process that the foam cotton head 2 enters the through hole X to move down, the foam cotton head 2 can trigger the squeezing plate 5 and drive the lower end of the squeezing plate 5 to overturn to the outside of the squeezing tip 33 so as to realize evasion.

As shown in FIGS. 20-23, a sixth embodiment of the present invention is shown.

Differences between this embodiment and the first embodiment are as follows. The squeezing mechanisms are adapted for squeezing side faces P of front and rear sides of the foam cotton head 2. During the upward movement of the foam cotton head 2 relative to the wringing frame 3, the squeezing mechanisms enable the foam cotton head 2 to generate the first amount of deformation Δh1 in a width direction D. During the downward movement of the foam cotton head 2 relative to the wringing frame 3, the squeezing mechanisms enable the foam cotton head 2 to generate the second amount of deformation Δh2 in the width direction D. The wringing frame 3 has a through hole X for allowing an end face M of the foam cotton head 2 to pass therethrough. There are two squeezing mechanisms which are respectively arranged on front and rear inside the through hole 31 and can swing relative to the wringing frame 3. During a wringing frame, the foam cotton head 2 is rotated to allow the end face M to be aligned with the through hole X. In the process that the foam cotton head 2 enters the through hole X and moves up, the two squeezing mechanisms that do not swing enable the foam cotton head 2 to generate the first amount of deformation Δh1. In the process that the foam cotton head 2 enters the through hole X and moves down, the two swung squeezing mechanisms enable the foam cotton head 2 to generate the second amount of deformation Δh2.

In this embodiment, each of the squeezing mechanisms includes a squeezing plate 5 and a connecting plate 6. A wringing roller 4 for being contact with the side surfaces P of the foam cotton head 2 is provided on the squeezing plate 5, and the squeezing plate 5 is rotatably constrained within the through hole X and is movable up and down within a certain range in the axial direction of the through hole X. One end of the connecting plate 6 is rotatably connected within the through hole X, while the other end of the connecting plate 6 is hinged to the upper end of the squeezing plate 5. An elastic member 7 for keeping a lower end of the connecting plate 6 in a trend of deflecting close to the side faces P of the foam cotton head 2 is provided within the through hole X, and a limiting structure for limiting an upward movement of the connecting plate 6 is further provided within the through hole X. The limiting structure can refer to Embodiment 1.

Of course, it is also possible that one of the squeezing mechanisms employs the above structure and the other one of the squeezing mechanisms employs a fixed-type inclined squeezing plate structure.

What is claimed is:

1. A self-wringing foam cotton mop with a labor-saving wringing operation, the self-wringing foam cotton mop comprising a mop rod and a foam cotton head, wherein:

the foam cotton head is rotatably connected to a bottom end of the mop rod;

a wringing frame is disposed on the mop rod;

during mopping, the foam cotton head is separated from the wringing frame;

a squeezing mechanism capable of squeezing the foam cotton head entering the wringing frame is disposed on the wringing frame;

a position of the squeezing mechanism is changeable, so that the position of the squeezing mechanism when the foam cotton head is moved upward relative to the wringing frame is different from the position of the squeezing mechanism when the foam cotton head is moved downward relative to the wringing frame;

a first amount of deformation generated by the foam cotton head during an upward movement of the foam cotton head relative to the wringing frame is greater than the second amount of deformation generated by the foam cotton head during a downward movement of the foam cotton head relative to the wringing frame;

the squeezing mechanism is adapted for squeezing a bottom surface of the foam cotton head to realize the wringing operation; when the foam cotton head is moved up relative to the wringing frame, the squeezing mechanism enables the foam cotton head to generate the first amount of deformation in a thickness direction; and when the foam cotton head is moved down relative to the wringing frame, the squeezing mechanism enables the foam cotton head to generate the second amount of deformation in the thickness direction;

the wringing frame comprises a through hole for allowing an end surface of the foam cotton head to pass therethrough, and the squeezing mechanism is disposed within the through hole and is able to swing relative to the wringing frame; during a wringing process, the foam cotton head is rotated to allow the end surface to be aligned with the through hole; in the process that the foam cotton head enters the through hole and moves up relative to the wringing frame, the squeezing mechanism that does not swing enables the foam cotton head to generate the first amount of deformation; and in the process that the foam cotton head enters the through hole and moves down relative to the wringing frame, the swung squeezing mechanism enables the foam cotton head to generate the second amount of deformation; and the squeezing mechanism comprises a squeezing plate and a connecting plate; the squeezing plate is adapted to be in contact with the bottom surface of the foam cotton head, and the squeezing plate is rotatably constrained on the wringing frame and is movable up and down within a certain range in an axial direction of the wringing frame; one end of the connecting plate is rotatably connected to the wringing frame, while the other end of the connecting plate is hinged to an upper end of the squeezing plate; and an elastic member for keeping a lower end of the connecting plate deflected close to the bottom surface of the foam cotton head and a limiting structure for limiting an upward movement of the connecting plate are disposed on the wringing frame.

2. The self-wringing foam cotton mop of claim 1, wherein the limiting structure comprises arc-shaped guide grooves formed on left and right inner sidewalls of the through hole;

guide columns inserted into the guide grooves are disposed in a middle portion of left and right sides of the squeezing plate; and by limiting the guide columns through upper inner sidewalls of the guide grooves, during the upward movement of the foam cotton head relative to the through hole, the squeezing plate is always kept at a position where it is gradually inclined towards the bottom surface of the foam cotton head from the bottom up.

3. The self-wringing foam cotton mop of claim 1, wherein a wringing roller adapted to be in contact with the bottom surface of the foam cotton head is disposed on the squeezing plate.

4. A self-wringing foam cotton mop with a labor-saving wringing operation, the self-wringing foam cotton mop comprising a mop rod and a foam cotton head, wherein:

the foam cotton head is rotatably connected to a bottom end of the mop rod;

a wringing frame is disposed on the mop rod;

during mopping, the foam cotton head is separated from the wringing frame;

a squeezing mechanism capable of squeezing the foam cotton head entering the wringing frame is disposed on the wringing frame;

a position of the squeezing mechanism is changeable, so that the position of the squeezing mechanism when the foam cotton head is moved upward relative to the wringing frame is different from the position of the squeezing mechanism when the foam cotton head is moved downward relative to the wringing frame;

a first amount of deformation generated by the foam cotton head during an upward movement of the foam cotton head relative to the wringing frame is greater than the second amount of deformation generated by the foam cotton head during a downward movement of the foam cotton head relative to the wringing frame;

wherein the squeezing mechanism is adapted for squeezing side surfaces of front and rear sides of the foam cotton head;

when the foam cotton head is moved up relative to the wringing frame, the squeezing mechanism enables the foam cotton head to generate the first amount of deformation in a width direction;

when the foam cotton head is moved down relative to the wringing frame, the squeezing mechanism enables the foam cotton head to generate the second amount of deformation in the width direction;

wherein the wringing frame comprises a through hole for allowing an end surface of the foam cotton head to pass therethrough;

two squeezing mechanisms are respectively arranged on front and rear sides inside the through hole and can swing relative to the wringing frame;

during a wringing process, the foam cotton head is rotated to allow the end surface to be aligned with the through hole;

in the process that the foam cotton head enters the through hole and moves up relative to the wringing frame, the two squeezing mechanisms that do not swing enable the foam cotton head to generate the first amount of deformation;

in the process that the foam cotton head enters the through hole and moves down relative to the wringing frame, the two swung squeezing mechanisms enable the foam cotton head to generate the second amount of deformation;

at least one of the squeezing mechanisms comprises a squeezing plate and a connecting plate;

a wringing roller for being contact with the side surfaces of the foam cotton head is disposed on the squeezing plate, and the squeezing plate is rotatably constrained on the wringing frame and is movable up and down within a certain range in an axial direction of the wringing frame;

one end of the connecting plate is rotatably connected to the wringing frame, while the other end of the connecting plate is hinged to an upper end of the squeezing plate; and an elastic member for keeping a lower end of the connecting plate in a trend of deflecting close to the side surface of the foam cotton head and a limiting structure for limiting an upward movement of the connecting plate are disposed on the wringing frame.

* * * * *